US008286644B2

(12) United States Patent
Bennett

(10) Patent No.: US 8,286,644 B2
(45) Date of Patent: Oct. 16, 2012

(54) COSMETIC CONTAINER

(75) Inventor: Kyle M. Bennett, Gouverneur, NY (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 115 days.

(21) Appl. No.: 12/790,374

(22) Filed: May 28, 2010

(65) Prior Publication Data

US 2010/0300476 A1 Dec. 2, 2010

Related U.S. Application Data

(60) Provisional application No. 61/182,029, filed on May 28, 2009.

(51) Int. Cl.
*A45D 40/26* (2006.01)
*A45D 42/00* (2006.01)

(52) U.S. Cl. ..... 132/218; 132/216; 132/316; 132/317; 401/129

(58) Field of Classification Search ..... 132/212, 132/216, 218, 286, 291, 293, 295–297, 301–306, 132/311, 313, 315–318; 15/184, 185; 206/756, 206/759, 766; 401/269, 126, 129; *A45D 40/26, A45D 42/00*

See application file for complete search history.

(56) References Cited

U.S. PATENT DOCUMENTS 892,246 A * 6/1908 Gamber ..... 132/313
1,485,172 A * 2/1924 Dowell ..... 206/581
1,503,378 A * 7/1924 Reid ..... 132/296
1,506,589 A * 8/1924 Jaroslawski-Fioret ..... 132/296
1,525,665 A * 2/1925 Slover et al. ..... 132/287
1,607,448 A * 11/1926 Dykes ..... 15/185
1,754,981 A * 4/1930 Coryell ..... 132/296
1,760,481 A * 5/1930 Coryell ..... 132/296
1,875,127 A * 8/1932 Parkin ..... 132/296
1,986,086 A * 1/1935 Weiss ..... 362/142
2,196,017 A * 4/1940 Kane ..... 220/520
2,254,300 A 9/1941 Lessin
2,264,300 A * 12/1941 Davies ..... 312/31
2,459,733 A * 1/1949 Macy ..... 132/316
3,809,102 A * 5/1974 Ross ..... 132/297
3,942,540 A * 3/1976 Gause ..... 132/313
4,339,104 A 7/1982 Weidman
4,685,558 A * 8/1987 Filiz et al. ..... 206/1.5
(Continued)

OTHER PUBLICATIONS

U.S. Patent and Trademark Office (ISA/US); International Search Report and the Written Opinion of the International Searching Authority, or the Declaration, Mar. 19, 2010; pp. 1-8; U.S. Patent and Trademark Office; U.S.

*Primary Examiner* — Robyn Doan
*Assistant Examiner* — Tatiana Nobrega
(74) *Attorney, Agent, or Firm* — Middleton Reutlinger; Chad D. Bruggeman; John F. Salazar

(57) ABSTRACT

A cosmetic container for retaining and dispensing a cosmetic material is provided. The container includes a body including a first portion and a second portion that are pivotally coupled together, an applicator coupled to the second portion and a mirrored element pivotally coupled to the first portion. The mirrored element is moveable between a retracted position and an extended position. The mirrored element has a reflective surface that is positionable behind the applicator when the mirrored element is in the extended position and may define an outer periphery of the body when the mirrored element is in the retracted position.

20 Claims, 4 Drawing Sheets

U.S. PATENT DOCUMENTS 5,012,831 A * 5/1991 Canela ..... 132/313
5,054,505 A * 10/1991 Yuhara ..... 132/294
5,320,125 A 6/1994 Barnhart
5,337,890 A * 8/1994 Lai ..... 206/235
5,437,294 A * 8/1995 Ebbets et al. ..... 132/304
5,513,754 A * 5/1996 Chang ..... 206/581
5,735,298 A * 4/1998 Mayne et al. ..... 132/309
5,819,764 A * 10/1998 Sussman ..... 132/293
5,970,990 A * 10/1999 Dunton et al. ..... 132/218
5,988,917 A 11/1999 Sheffler et al.
6,305,861 B1 * 10/2001 Gueret ..... 401/122
6,889,696 B2 * 5/2005 Thorpe et al. ..... 132/287
6,997,321 B2 * 2/2006 Young ..... 206/581
7,422,018 B2 * 9/2008 Dieudonat ..... 132/294
2003/0154996 A1 * 8/2003 Bourjal ..... 132/293
2004/0003825 A1 * 1/2004 Kelly ..... 132/301
2005/0150513 A1 * 7/2005 Taylor ..... 132/316
2006/0231116 A1 * 10/2006 Kaiser et al. ..... 132/295
2008/0138138 A1 * 6/2008 Gueret ..... 401/24
2008/0289645 A1 * 11/2008 Guillot ..... 132/200
2009/0044827 A1 * 2/2009 Zilber et al. ..... 132/297
2009/0229627 A1 * 9/2009 Golden et al. ..... 132/288
2009/0308782 A1 * 12/2009 Grist ..... 206/581
2009/0320874 A1 * 12/2009 Boye et al. ..... 132/295
2010/0221059 A1 * 9/2010 Bennett ..... 401/118
2010/0224212 A1 * 9/2010 Chen ..... 132/287
2010/0288299 A1 * 11/2010 Won ..... 132/293

* cited by examiner

COSMETIC CONTAINER

CROSS REFERENCE TO RELATED APPLICATION(S)

This nonprovisional patent application claims priority to and benefit from (under 35 U.S.C. §119(e)), currently pending, U.S. Provisional Patent Application Ser. No. 61/182,029, filed on May 28, 2009.

BACKGROUND

The present disclosure relates generally to a container configured to hold and dispense a cosmetic material (e.g., mascara, lip gloss, eye liner, lipstick, etc.). More particularly, the present disclosure relates to a container configured to support a mirrored element to assist a user in applying the cosmetic material.

A minor is often used when applying a cosmetic material. A mirror helps a user to ensure that the cosmetic material is applied to the proper location on their person and in the proper amount. A mirror may also enable a user to identify and correct mistakes made while dispensing and/or applying the cosmetic material. In certain situations, such as when a user is applying mascara, lip gloss, lipstick or the like, a user often must locate a standalone minor or utilize the minor from a secondary cosmetic container (e.g., a pressed powder compact having a minor, etc.) when applying the cosmetic material. Neither arrangement is particularly favorable because a user may have difficulty locating a standalone minor or may have difficulty trying to juggle both a primary cosmetic container for applying the cosmetic material and a secondary cosmetic container for use of the mirror. Further still, such arrangements may make it difficult for a user to get a sufficient view of the areas to which the cosmetic material is to be applied which could result in a misapplication of the cosmetic material.

Accordingly, there is a need for an improved container for dispensing and/or applying a cosmetic material that supports a mirrored element to assist a user in applying the cosmetic material.

SUMMARY

One embodiment relates to a cosmetic container for retaining and dispensing a cosmetic material. The cosmetic container includes a body including a first portion and a second portion. The first portion is pivotally coupled to the second portion. The cosmetic container also includes an applicator coupled to the second portion. The cosmetic container further includes a mirrored element coupled to the first portion. The mirrored portion has a reflective surface that is positionable behind the applicator.

Another embodiment also relates to a cosmetic container for retaining and dispensing a cosmetic material. The container includes a body, an applicator coupled to the body and a mirrored element pivotally coupled to the body. The mirrored element is moveable between a retracted position and an extended position. The mirrored element has a reflective surface that is positionable behind the applicator when the mirrored element is in the extended position and defines an outer periphery of the body when the mirrored element is in the retracted position.

Another embodiment further relates to a cosmetic container for retaining and dispensing a cosmetic material. The container includes a body including a first portion and a second portion that are pivotally coupled together, an applicator coupled to the second portion and a mirrored element pivotally coupled to the first portion. The mirrored element is moveable between a retracted position and an extended position. The mirrored element has a reflective surface that is positionable behind the applicator when the mirrored element is in the extended position and defines an outer periphery of the body when the mirrored element is in the retracted position.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
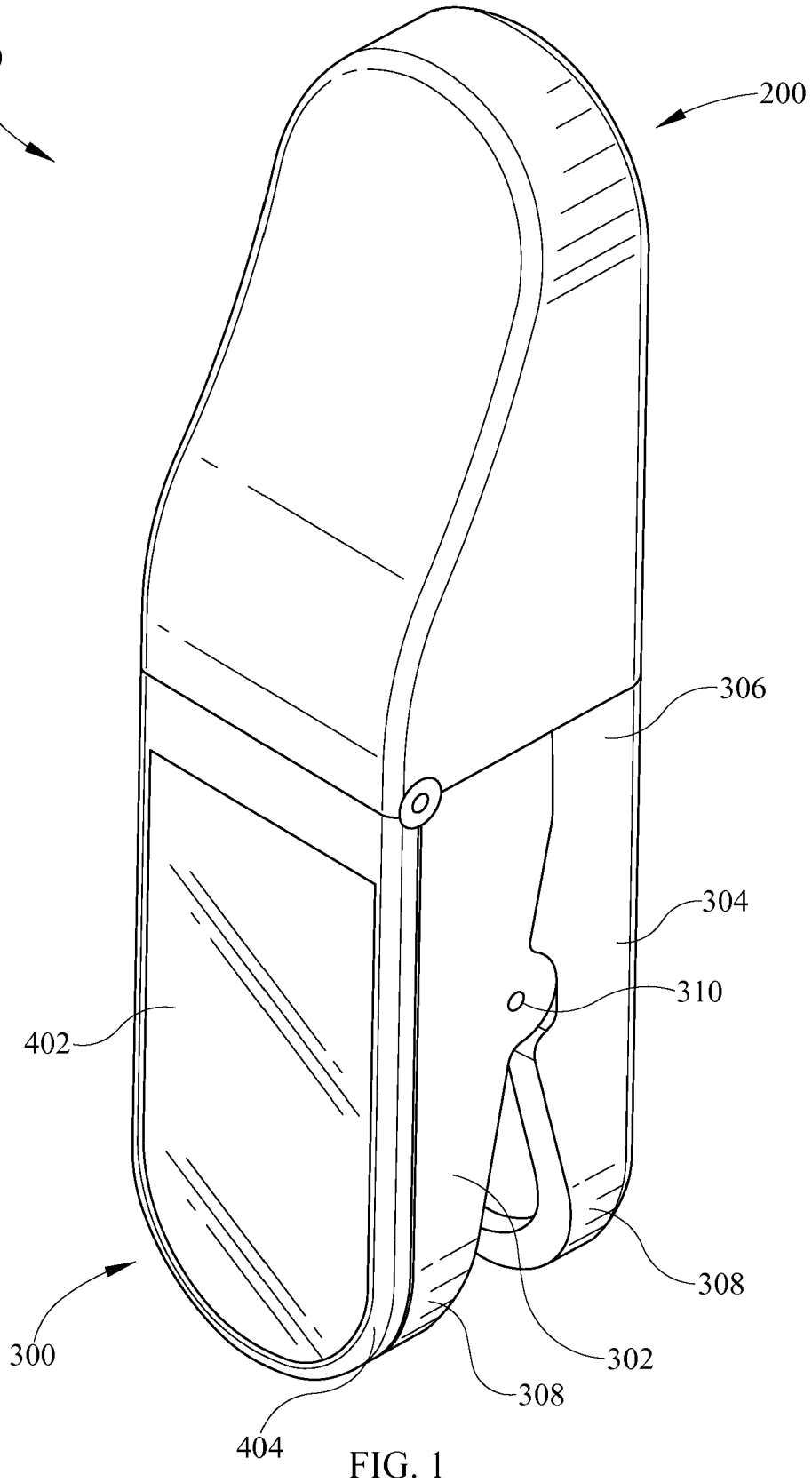
FIG. 1 is a perspective view of a container in a closed position shown according to an exemplary embodiment.

A container that is configured to retain and selectively dispense a cosmetic material (e.g., lip gloss, eye liner, mascara, nail polish, cover-up, foundation, or other beauty aid, etc.) is disclosed. According to an exemplary embodiment, the container is configured to retain and selectively dispense a liquid cosmetic material.

For purposes of the present disclosure, the term cosmetic material is used broadly to refer to any material which can be applied topically to the skin or other area on the user. Such materials include, but are not limited to, materials designed to alter, conceal or enhance appearance or odor of the user and materials that provide a topical (e.g., skin, etc.) treatment or protection for the user. The term liquid material is used broadly to refer to any non-solid substance including, but not limited to, a gel, semi-liquid or semi-solid. The term liquid material is intended to cover substances including those with a relatively high viscosity (e.g., gels, etc.), those with a relatively low viscosity (e.g., water, etc.) and anything in between. The liquid material may be substantially homogeneous, or may have particles, including solid particles, suspended or otherwise contained therein.

It should be noted at the outset that while the container described herein will be described as a container configured to retain and dispense a cosmetic material, the inventions disclosed herein have broad applicability to a variety of containers. For example, the inventions disclosed herein may be suitable for with, but not limited to, containers used for holding adhesives, paints, cleaning products, pharmaceuticals or any other material wherein it would be desirable to provide such a container. Further, while the container described herein is preferably sized to fit conveniently into a user's bag, purse, pocket, etc., the inventions disclosed herein are suitable for use with larger containers.

In the following detailed description, for purposes of explanation and not limitation, representative embodiments disclosing specific details are set forth in order to provide a thorough understanding of the claimed invention. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the claimed invention.

In addition to retaining and dispensing a cosmetic material, the container is also configured to support a mirrored element that may assist a user when applying the cosmetic material. Inclusion of the mirrored element may eliminate the need to use a separate mirror (e.g., a bathroom vanity mirror, car vanity, separate compact, etc.). The mirrored element may enable the user to apply the cosmetic material at a relatively close range for improved visibility, making the user capable of more precise application. According to an exemplary embodiment, the container allows for single handed application of the cosmetic material and support of a mirror by a user. Such an arrangement provides a container that is relatively convenient to use and easily portable.

Figure 2:
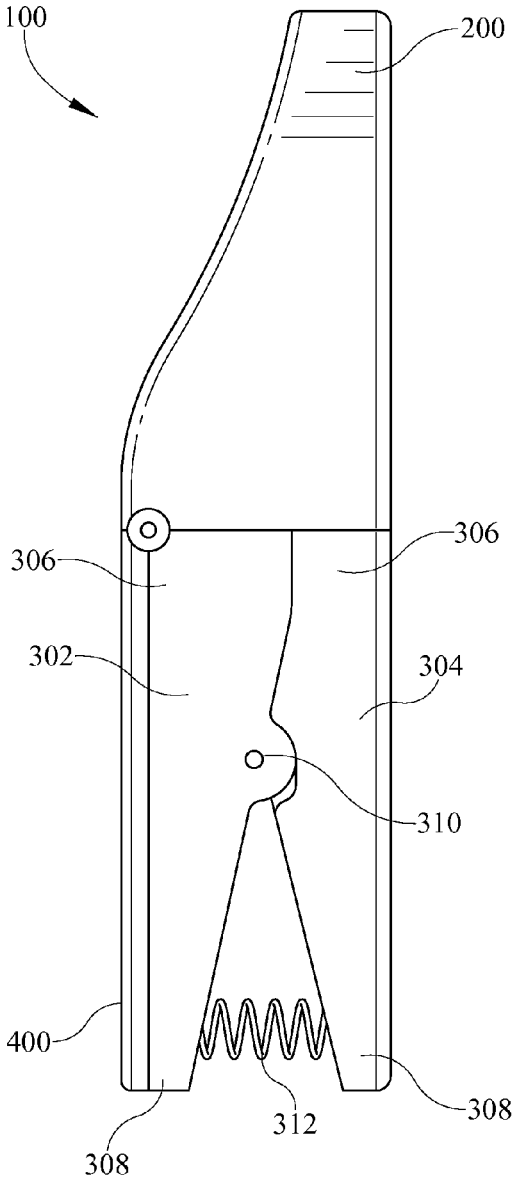
FIG. 2 is a side view of the container of FIG. 1 in the closed position.
Figure 3:
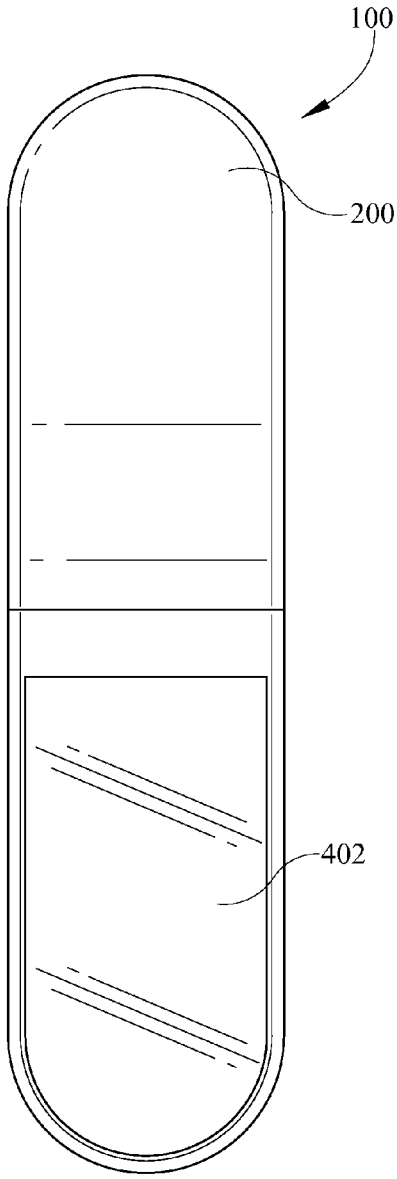
FIG. 3 is a front view of the container of FIG. 1 in the closed position.
Figure 5:
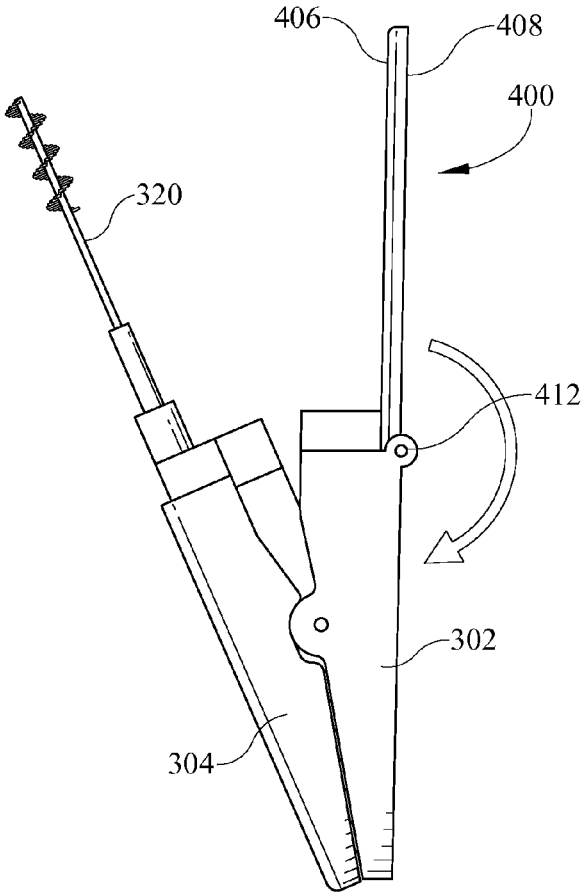
FIG. 5 is a side view of the container of FIG. 1 in the open position.
Figure 6:
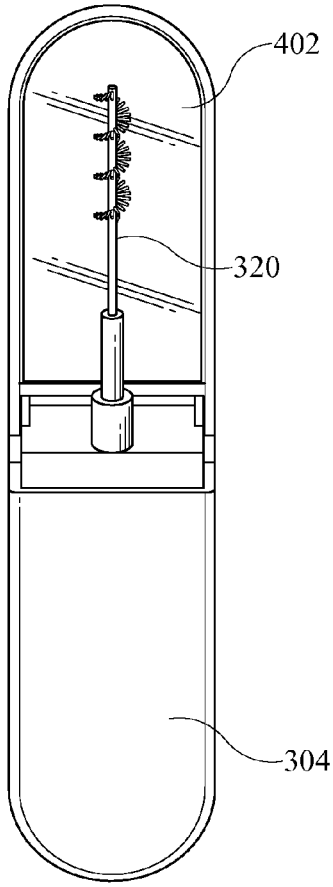
FIG. 6 is a front view of the container of FIG. 1 in the open position.

Referring now to the FIGURES, and in particular FIG. 1, the container is shown according to one nonexclusive exemplary embodiment as a container 100. Container 100 generally includes a first portion (e.g., cap, closure, etc.), shown as a cover portion 200, and a second portion (e.g., housing, base, etc.), shown as a body portion 300. Cover portion 200 and body portion 300 cooperate to provide a conveniently sized storage system suitable for retaining, dispensing and/or applying a cosmetic material. Container 100 may be provided in any of a number of shapes. Container 100 is configured to be selectively moved by a user between a first or closed portion (shown in FIGS. 1-3) and a second or open position (shown in FIGS. 4-6). According to the embodiment illustrated, container 100 is substantially oblong in shape and extends along a longitudinal axis between a first or top end, defined by cover portion 200, and a second or bottom end, defined by body portion 300.

According to an exemplary embodiment, body portion 300 generally includes a first member, shown as a first leg 302, and a second member, shown as a second leg 304. First leg 302 and second leg 304 are complemental body members that each extend between a first or upper end 306 and a second or lower end 308. One or more of first leg 302 and second leg 304 are selectively movable relative to the other of first leg 302 and second leg 304.

According to an exemplary embodiment, first leg 302 and second leg 304 are pivotally coupled to one another. For example, first leg 302 and second leg 304 are shown as being pivotally coupled to one another about an axis that is defined by a pivot pin or shaft 310 and provided between upper ends 306 and lower ends 308. According to the embodiment illustrated, first leg 302 and second leg 304 are pivotally coupled to one another at substantially a midpoint between upper ends 306 and lower ends 308. According to the various alternative embodiments, first leg 302 and second leg 304 may be pivotally coupled at area closer to upper ends 306 or closer to lower ends 308. According to the various alternative embodiments, pivot shaft 310 may be replaced with any known or otherwise suitable fastener for coupling together members in a pivotal manner.

First leg 302 and second leg 304 are pivotally coupled to one another so that a user can selectively separate (e.g., move apart, etc.) upper end 306 of first leg 302 from upper end 306 of second leg 304. According to an exemplary embodiment, such movement can only be accomplished when container 100 is in the open position (e.g., when cover portion 200 has been detached or otherwise removed from body portion 300, etc.). According to the embodiment illustrated, to separate upper end 306 of first leg 302 from upper end 306 of second leg 304, a user is required to depress lower ends 308 of first leg 302 and second leg 304 to effectuate the pivotal movement. According to the various alternative embodiments, container 100 may be configured so that a user actuates a button or a switch to effectuate the movement of first leg 302 and/or second leg 304 rather than depressing lower ends 308. According to further alternative embodiments, container 100 may be configured so that only one portion of base portion 300 is configured to move (e.g., rotate, etc.) relative to the remainder of body portion 300. For example, container 100 may be configured so that second leg 304 can be selectively rotated or otherwise moved while first leg 302 remains relatively fixed.

According to an exemplary embodiment, first leg 302 and second leg 304 are formed of a moldable material (e.g., plastic, etc.) in a forming process (e.g., injection molding process, etc.). The moldable material (e.g., plastic, etc.) may be provided as a generally transparent material (e.g., clear, tinted, etc.), a generally opaque material (e.g., non-transparent, colored, etc.), or a combination of a transparent material and an opaque material. The moldable material may be suitable moldable plastic or other suitable materials for molding first leg 302 and/or second leg 304. According to the various alternative embodiments, first leg 302 and second leg 304 may be formed of any known or otherwise suitable material (e.g., glass, aluminum and/or an aluminum alloy, etc.). First leg 302 and/or second leg 304 may be made of anyone of these materials (or other suitable materials) alone or in combination with another material.

According to an exemplary embodiment, a biasing element, shown as spring 312, is provided for urging upper ends 306 of first leg 302 and second leg 304 towards one another. For such an embodiment, a user is required to depress bottom ends 308 of first leg 302 and second leg 304 with a force sufficient to overcome the biasing force applied by spring 312 in order to separate upper end 306 of first leg 302 from upper end 306 of second leg 304. When first leg 302 and second leg 304 are not depressed with a sufficient force, spring 312 forces the upper ends 306 of first leg 302 and second leg 304 together so that container 100 can be returned to the closed position.

According to the embodiment illustrated, spring 312 is a coil spring having a first end coupled to first leg 302 and a second end coupled to second leg 304. The ends of spring 312 are received within channels provided in both first leg 302 and second leg 304 and secured with a suitable attachment mechanism. According to the various alternative embodiments, the biasing element may be any type of device that urges upper ends 306 of first leg 302 and second leg 304 towards one another. For example, the biasing element may be torsion spring provided at or near pivot shaft 310. According to an exemplary embodiment, base portion 300 may include a latching mechanism (e.g., locking pin, button, switch, etc.) maintain base portion 300 in a desired position. For example, a latch mechanism may be provided that can be actuated to prevent first leg 302 and second leg 304 from moving relative to each other once a user has compressed lower ends 308.

Supported at upper end 306 of second leg 304 is an applicator (e.g., operating element, active portion, etc.), shown as a mascara wand 320. Mascara wand 320 extends outward from an upper surface of second leg 304. Supported at a distal end of mascara wand 320 are bristles configured to receive the cosmetic material for applying to a user. According to the embodiment illustrated, mascara wand 320 is substantially concentrically aligned with a support base, shown as projection 324, that also extends outward from the top surface of second leg 304. Projection 324 has a cross-sectional shape that substantially corresponds to the cross-sectional shape of an opening in cover portion 200. When cover portion 200 and body portion 300 are coupled together, projection 324 is received within the opening in cover portion 200. The type of applicator provided on second leg 304 may vary depending on the intended application of container 100. For example, according to the various alternative embodiments, the applicator may be a preformed swab, sponge applicator, miniature comb, or any other known or otherwise suitable applicator. According to further alternative embodiments, the applicator may the tip of a lipstick supported within second leg 304. In such an embodiment, the cosmetic material may be retained within base portion 300.

Supported at first leg 302 is a mirrored element 400. Mirrored element 400 provides a reflective surface that may be useful to a user when applying a cosmetic material. Mirrored element 400 is configured to be movably coupled to first leg 302 so that a user may move mirrored element 400 from a first or retracted position (shown in FIGS. 1-3) to a second or extended position (shown in FIGS. 4-6). Moving mirrored element 400 to the extended position may be useful when applying and/or dispensing the cosmetic material. According to the embodiment illustrated, mirrored element 400 can be used by a user when in both the retracted position and the extended position.

According to an exemplary embodiment, mirrored element 400 generally includes a reflective surface, shown as a mirror 402, and a support structure, shown as a mirror support 404. Minor 402 may be formed of any of a variety of reflective materials including, but not limited to, glass, plastics and/or a film material. Minor support 404 includes a first or front side 406, and a second or rear side 408. According to the embodiment illustrated, mirror 402 is secured to front side 406. Mirror 402 may be secured in accordance with any number of methods (e.g., press-fit, snap-fit, fasteners, welding, etc.). For example, minor 402 can be secured for to the internal surface of front side 410 with an adhesive.

According to an exemplary embodiment, minor support 404 is formed of a moldable material (e.g., plastic, etc.) in a forming process (e.g., injection molding process, etc.). The moldable material (e.g., plastic, etc.) may be provided as a generally transparent material (e.g., clear, tinted, etc.), a generally opaque material (e.g., non-transparent, colored, etc.), or a combination of a transparent material and an opaque material. The moldable material may be suitable moldable plastic or other suitable materials for molding a receptacle. According to the various alternative embodiments, mirror support 404 may be formed of any known or otherwise suitable material capable of providing a substantially rigid structure (e.g., glass, aluminum and/or an aluminum alloy, etc.). Minor support 404 may be made of anyone of these materials (or other suitable materials) alone or in combination with another material.

To facilitate coupling mirrored element 400 to body portion 300 in a movable manner, a hinge 412 is provided between first leg 302 and mirror support 404. Hinge 412 allows mirrored element 400 to be selectively rotated between the retracted position and the extended position. According to the embodiment illustrated, hinge 412 is provided upper end 306 of first leg 302 so that when mirrored element 400 is rotated to the extended position, minor 402 is substantially behind or otherwise aligned with mascara wand 320.

According to an exemplary embodiment, mirrored element 400 is configured to be rotated at least 180 degrees when moving between the retracted position and the extended position. It should be noted that mirrored element 400 may be selectively stopped and positioned at an angle within this range that may be beneficial for assisting a user with application of the cosmetic material. According to the various alternative embodiments, mirrored element 400 may be configured to rotate greater than or less than 180 degrees when moving between the retracted position and the extended position. For example, mirrored element 400 may be configured to rotate beyond 180 degrees when in the extended position to help a user achieve a more desired angle between minor 402 and mascara wand 320. According to further alternative embodiments, mirrored element 400 may be movably coupled to body portion 300 in any of a variety of manners. For example, mirrored element 400 may be slidable coupled body portion 300 such that a user would be required to slide mirrored element 400 between the retracted position and the extended position.

According to the embodiment illustrated, the shape of mirror support structure 404 substantially corresponds in-part to the shape defined by body portion 300, and in particular first leg 302. When container 100 is in the closed position, mirrored element 400 is in the retracted position. When mirrored element 400 is retracted, mirrored element 400 is substantially aligned with an external surface of first leg 302 such that it defines an outer peripheral surface of body portion 300.

Figure 4:
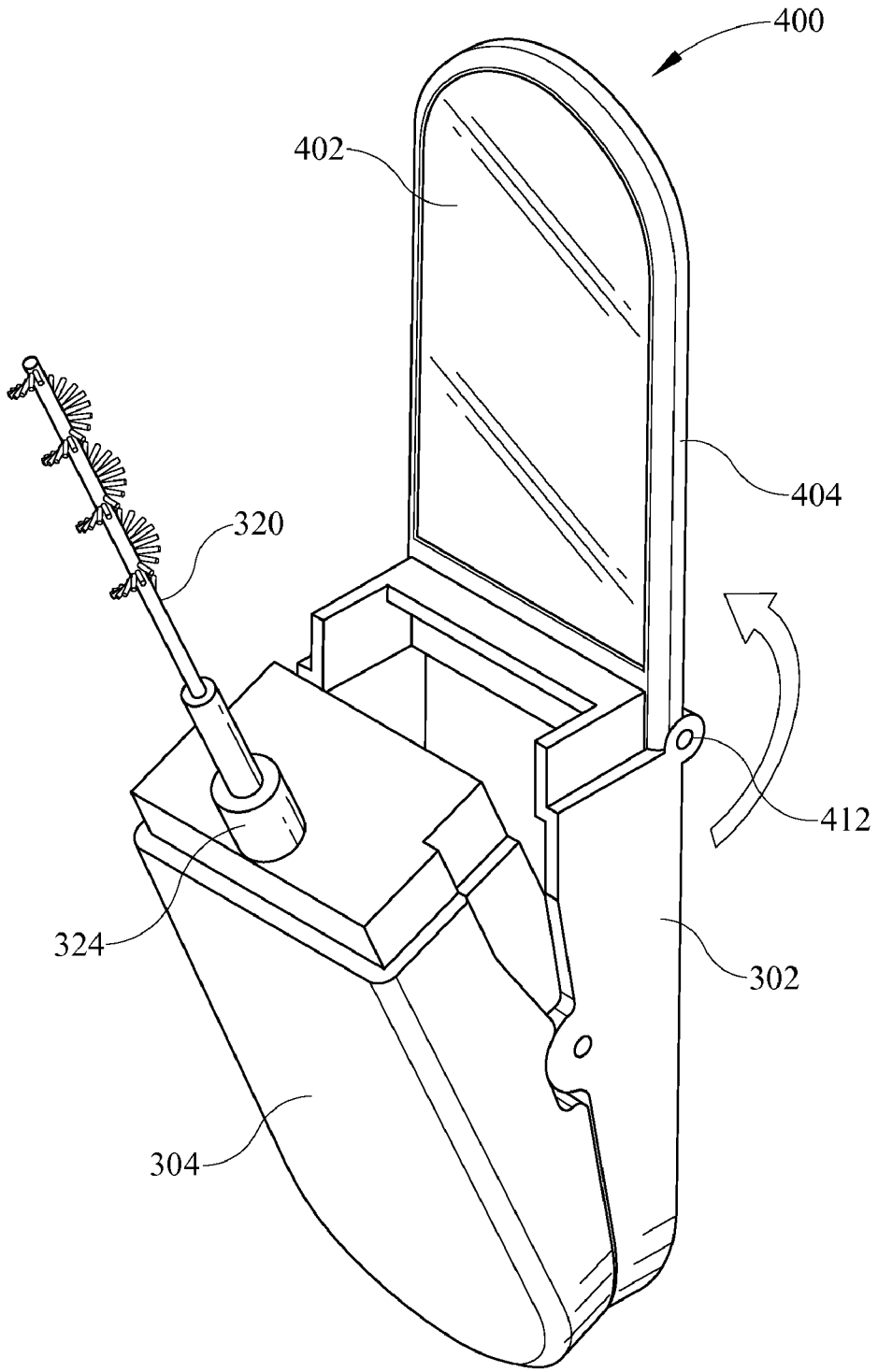
FIG. 4 is a perspective view of the container of FIG. 1 in an open position.

Referring to FIG. 4, mirrored element 400 is shown in the extended position. To move mirrored element 400 from the retracted position to the extended position, the user can grasp minor support 404 and selectively rotate mirrored element 400 about hinge 412. In the extended position, mirrored portion 400 is positioned such that the user can view application of a cosmetic material to their person using mirror 402. For example, in the extended position, mirror 402 may be substantially parallel to mascara wand 320 such that during dispensing and/or application of the mascara, the eye of the user, the mascara wand 320, and mirror 402 are substantially aligned. In this manner, the user is able to perform a precise, single handed application of a cosmetic material with improved visibility and without the need for an external mirror. As already indicated, mirrored element 400 is capable of being pivoted in positions other than the extreme extended position. As such, when mirrored element 400 is in the extended position, a user may adjust the angle of mirrored element 400 by pushing mirrored element 400 to move mirror 402 away from or towards mascara wand 320.

Referring back to FIGS. 1-3, cover portion 200 is shown according to an exemplary embodiment. Cover portion 200 functions as a cap to close off and/or protect the applicator when container 100 is in the closed position. According to an exemplary embodiment, cover portion 200 may also function as a receptacle for retaining a cosmetic material that is configured to be applied to the applicator. According to the embodiment illustrated, cover portion 200 defines a cavity (e.g., hollow area, storage area, etc.) that is configured to at least partially receive mascara wand 320. According to an exemplary embodiment, the cavity is also configured to retain the cosmetic material, such as a liquid mascara. By inserting mascara wand 320 into the cavity, the cosmetic material is applied to mascara wand 320. The size and shape of the cavity may vary depending on a number of design criteria. According to the various alternative embodiments, the cosmetic material may be retained in body portion 300, such as second leg 304, rather than in cover portion 200. In such an embodiment, the cosmetic material would be moved from body portion 300 to the applicator.

Cover portion 200 includes a bottom that is configured to receive and be coupled to body portion 300. In order to receive body portion 300, the bottom surface defines an opening or aperture that has a cross sectional shape that substantially corresponds to the cross sectional shape of the portion of body portion 300 that is received within cover portion 200. According to the embodiment illustrated, upper ends 306 of first leg 302 and second leg 304 are both received by cover portion 200 when container 100 is in the closed position.

According to an exemplary embodiment, the aperture within cover portion 200 that receives body portion 300 is sized to be slightly larger than an outer periphery of the portion of body portion 300 that is received within cover portion 200 so that there is little or no gap between the structures. Such a configuration may assist in guiding body portion 300 into cover portion 200 when a user is returning container 100 to the closed position. Such a configuration may also allow the overall size (e.g., circumference, diameter, etc.) to be reduced. Such a configuration may further provide a sealing function (e.g., by providing a substantially hermetic or airtight seal between cover portion 200 and body portion 300, etc.). To assist in removing excess cosmetic material from mascara wand 320, a wiper element (e.g., gasket, seal, sponge, etc.) may be provided within cover portion 200 that is configured to engage mascara wand 320 when cover portion 200 is added to or removed from body portion 300.

According to the embodiment illustrated, cover portion 200 is detached or otherwise removed from body portion 300 when container 100 is in the open position. According to the various alternative embodiments, instead of being detached from body portion 300, cover portion 200 may remain attached to body portion 300 when container 100 is moved to the open position. For example, a hinge, a strap, a linking member or some other structure may be provided for coupling cover portion 200 to body portion 300 when container 100 is in the open position. According to the embodiment illustrated, to facilitate coupling of cover portion 200 to body portion 300, the aperture defined by the bottom surface of cover portion 200 is configured to receive upper ends 306 of first leg 302 and second leg 304 in a press-fit manner. According to various alternative embodiments, any suitable attachment structure (e.g., a threaded connection, snap-fit structure, ribs, interference fit, etc.) for releasably securing cover portion 200 to body portion 300.

According to an exemplary embodiment, cover portion 200 is formed of a moldable material (e.g. plastic, etc.) in a forming process (e.g. injection molding process, etc.) similar to body portion 300. The moldable material (e.g. plastic, etc.) may be provided as a generally transparent material (e.g. clear, tinted, etc.), a generally opaque material (e.g. non-transparent, colored, etc.), or a combination of a transparent material and an opaque material. The moldable material may be suitable moldable plastic or other suitable materials for molding a receptacle. According to the various alternative embodiments, cover portion 200 may be formed of any known or otherwise suitable material capable of providing a substantially rigid structure (e.g., glass, aluminum and/or an aluminum alloy, etc.). Cover portion 200 may be made of anyone of these materials (or other suitable materials) alone or in combination with another material.

To operate container 100, a user must first move container 100 to the open position. According to the embodiment illustrated, container 100 is moved to the open position by removing cover portion 200 from body portion 300. Since the cosmetic material is retained with cover portion 200, when cover portion 200 is removed from body portion 300, the cosmetic material is already provided on mascara wand 320. With container 100 in the open position, a user may then selectively rotate mirrored element 400 towards the extended position (the movement of which is shown by the arrow in FIG. 4). In the extended position, mirror 402 is positioned substantially behind and faces mascara wand 320. To adjust the angular relationship between mirror 402 and mascara wand 320, a user can adjust the position of mirrored element 400 and/or may adjust the position of mascara wand 320. A user can adjust the position of the mascara wand 320 by depressing lower ends 308 of first leg 302 and second leg 304 towards one another so that mascara wand 320 moves away from minor 402. The user can continue to adjust and readjust the positioning between mirror 402 and mascara wand 320 as the cosmetic material is being applied. When the user is finished applying the cosmetic material, the user releases any pressure being applied to lower ends 308 of first leg 302 and second leg 304 and returns mirrored element to the retracted position. Spring 312 will then move upper ends 306 of first leg 302 and second leg 304 towards one another so that cover portion 200 can be reattached to body portion 300.

It is important to note that the construction and arrangement of the elements of the container as shown in the exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. Further, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the appended claims.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited. Also, any reference numerals or other characters, appearing between parentheses in the claims, are provided merely for convenience and are not intended to limit the claims in any way, In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The invention claimed is:

1. A cosmetic container for retaining and dispensing a cosmetic material, said container comprising:

a body including a first portion and a second portion, said first portion being pivotally coupled to said second portion;

an applicator coupled to said second portion; and a mirrored element having a reflective surface, wherein said mirrored element is pivotally coupled to said first portion and moveable between a retracted position and an extended position, when said mirrored element is pivoted relative to said first portion to said extended position said reflective surface of said mirrored element is positionable behind said applicator of said second portion wherein said mirrored element defines an outer periphery of said body when said mirrored element is in said retracted position; and a cover coupled to said body and moveable between a first position in which said container is closed and a second position in which said container is open wherein said cover includes a cavity configured to retain said cosmetic material.

2. The cosmetic container as in claim 1 wherein said first portion is pivotally coupled to said second portion about a pivot shaft.

3. The cosmetic container as in claim 1 wherein said pivotal coupling between said first portion and said second portion allows said applicator of said second portion to be selectively moved away from said reflective surface of said mirrored element.

4. The cosmetic container as in claim 1 wherein said applicator is a mascara wand configured to receive mascara for applying to a user.

5. The cosmetic container as in claim 1 wherein said applicator is at least partially inserted into said cavity when said container is closed.

6. The cosmetic container as in claim 1 wherein said cover is detached from said body when in said second position.

7. The cosmetic container as in claim 1 further including a biasing element provided between said first portion and said second portion.

8. The cosmetic container as in claim 7 wherein said biasing element urges an upper end of said first portion towards an upper end of said second portion.

9. The cosmetic container as in claim 7 wherein said biasing element is a spring configured to be compressed by a user.

10. A cosmetic container for retaining and dispensing a cosmetic material, said container comprising:

a body having a first leg pivotally coupled to a second leg;

an applicator coupled to said body second leg; and a mirrored element pivotally coupled to said body first leg and moveable between a retracted position and an extended position;

wherein said mirrored element has a reflective surface that is positioned behind said applicator when said mirrored element is pivoted relative to said body first leg to said extended position; and wherein said mirrored element defines an outer periphery of said body when said mirrored element is in said retracted position; and wherein said applicator of said body second leg can be selectively moved away from said mirrored element reflective surface of said body first leg by depressing lower ends of said first leg and said second leg.

11. The cosmetic container as in claim 10 wherein said mirrored element includes a support structure that is pivotally coupled to said body first leg.

12. The cosmetic container as in claim 11 wherein said support structure is configured to rotate approximately 180 degrees to allow said mirrored element to move from said retracted position to said extended position.

13. The cosmetic container as in claim 10 wherein said applicator of said body second leg being selectively movable relative to said mirrored element reflective surface of said body first leg.

14. The cosmetic container as in claim 10 wherein a spring is provided between said first leg and said second leg.

15. The cosmetic container as in claim 10 wherein said applicator is a mascara wand configured to receive mascara for applying to a user.

16. The cosmetic container as in claim 10 further including a cover coupled to said body and moveable between a first position in which said container is closed and a second position in which said container is open.

17. The cosmetic container as in claim 16 wherein said cover includes a cavity configured to retain said cosmetic material.

18. The cosmetic container as in claim 17 wherein said applicator is at least partially inserted into said cavity when said container is closed.

19. The cosmetic container as in claim 16 wherein said cover is detached from said body when in said second position.

20. A cosmetic container for retaining and dispensing a cosmetic material, said container comprising:

a body having a first leg pivotally coupled to a second leg;

a cover coupled to said body and moveable between a first position in which said container is closed and a second position in which said container is open wherein said cover includes a cavity configured to retain said cosmetic material;

an applicator sleeve having an annular opening, said applicator sleeve removeably receiving a wand handle of a mascara applicator; and a mirrored element pivotally coupled to said first leg and moveable between a retracted position and an extended position;

wherein said mirrored element has a reflective surface positionable behind said mascara applicator when said mirrored element is in said extended position and pivotally retracted behind said body when said mirrored element is in said retracted position.

* * * * *